US006353974B1

(12) United States Patent
Graf

(10) Patent No.: US 6,353,974 B1
(45) Date of Patent: Mar. 12, 2002

(54) CIRCULAR COMB ARRANGEMENT

(75) Inventor: Ralph A. Graf, Freienbach (CH)

(73) Assignee: Graf + Cie AG, Rapperswil (CH)

( * ) Notice: Subject to any disclaimer, the term of this patent is extended or adjusted under 35 U.S.C. 154(b) by 0 days.

(21) Appl. No.: 09/625,797

(22) Filed: Jul. 26, 2000

(30) Foreign Application Priority Data

Jul. 30, 1999 (DE) ..... 199 36 049

(51) Int. Cl.[7] ..... D01G 19/04
(52) U.S. Cl. ..... 19/234; 19/115 R; 19/233
(58) Field of Search ..... 19/112, 113, 114, 19/115 R, 233, 234, 215, 217

(56) References Cited

U.S. PATENT DOCUMENTS

| | | | | |
|---|---|---|---|---|
| 4,392,276 A | * | 7/1983 | Gauvain et al. | 19/112 |
| 5,566,541 A | * | 10/1996 | Stahlecker et al. | 19/114 |
| 5,657,512 A | * | 8/1997 | Graf | 19/233 |
| 6,195,843 B1 | * | 3/2001 | Graf | 19/114 |

FOREIGN PATENT DOCUMENTS

| | | |
|---|---|---|
| DE | 8430562 | 2/1985 |
| DE | 4326205 | 2/1995 |
| DE | 195 32 592 C1 | 8/1996 |
| DE | 196 49 808 A1 | 7/1997 |
| EP | 0179158 | 4/1986 |
| EP | 0382899 | 8/1990 |

* cited by examiner

*Primary Examiner*—John J. Calvert
*Assistant Examiner*—Gary L. Welch
(74) *Attorney, Agent, or Firm*—Friedrich Kueffner

(57) ABSTRACT

An arrangement for a rotatable circular comb for processing fibers supplied in the form of a fiber band has arrangement sections fastened on a circular cylindrical mantle surface that is rotatable about an axis of rotation in a direction of rotation. The arrangement sections are arranged behind one another in a circumferential direction of the circular cylindrical mantle surface such that the arrangement sections successively engage the fiber band in an engagement sequence when the arrangement is rotated in the direction of rotation. A first one of the arrangement sections that engages the fiber band first in the engagement sequence upon rotation of the arrangement is an engagement section and the arrangement sections arranged successively behind the engagement section are follower sections. The engagement section has a lesser combing effect than at least one of the follower sections. At least one of the follower sections has a greater length in the circumferential direction than the engagement section.

21 Claims, 3 Drawing Sheets

CIRCULAR COMB ARRANGEMENT

BACKGROUND OF THE INVENTION

1. Field of the Invention

The invention relates to an arrangement for a circular comb, employed for processing fibers supplied in the form of a fiber band and rotatable about an axis of rotation, with at least two arrangement sections arranged behind one another in the circumferential direction of a circular cylindrical mantle surface rotating about the axis of rotation, wherein the engagement section that engages first the fiber band upon rotation of the circular comb about the axis of rotation provides a lesser combing effect than at least one of the follower sections passing subsequently through the fiber band; a circular comb provided with such an arrangement; and a comber having such a circular comb.

2. Description of the Related Art

Circular combs provided with arrangements of the aforementioned kind are used during the processing or finishing of fibers in combers for separating short fibers and neps as well as shell parts from the already carded raw fiber material. In this connection, the combing process makes the staple, i.e., the fiber length of the raw fiber material, more uniform. For this purpose, the comber is arranged conventionally between the carding machine and the draw frame.

In the comber a fiber tuft of a fiber band comprised of preferably already carded fibers is fused to a fiber band of already combed fibers and secured by nippers, and the teeth of the circular comb then pass through the fiber tuft. The entire process of engagement of the comb teeth in the fiber tuft, the combing, the fusing up to the point when the circular comb engages a fiber tuft that is newly supplied to the nippers is referred to as "comb play".

Conventional circular combs comprise a substantially cylindrical support body wherein the comb extends over a portion of the circumference of the cylinder. During operation of the comber the circular comb rotates about the cylinder axis and is arranged relative to the nippers such that the teeth of the comb can pass through the fiber tuft secured by the nippers, but such that the support body upon further rotation of the circular comb does not hinder the fusing of the combed fiber tuft. Conventionally, the circular comb for this purpose is configured such that a base body is mounted on the cylindrical support body which expands the support body in the radial direction and on which the actual circular comb arrangement is secured.

In the development of circular combs, arrangements with round needles were initially employed. With such circular combs a processing speed of 100 to 110 comb plays per minute could be achieved while maintaining a satisfactory combing effect. By replacing the circular needles with all-steel sawtooth arrangements an increase of the processing speed up to 350 comb plays per minute could be realized without impeding the combing effect. A further increase of the processing speed could be obtained without affecting the actual combing results by a further development of conventional circular combs disclosed in DE 43 26 205 C1, in which a channel is arranged between the arrangement and the support body for preventing dynamic pressure in front of the arrangement.

When using the circular combs described in the aforementioned document, it was initially observed that the fibers to be processed were damaged at high processing speeds. For eliminating these shortcomings, arrangements of the aforementioned kind were suggested with which a damage-poor engagement of the arrangement via the engagement section in the fiber tuft can be achieved while with the follower sections the desired combing result can be produced. When using arrangements formed of sawtooth wire strips, the higher combing effect of the follower sections in the known arrangements is achieved by a corresponding reduction of the spacing between the tooth tips of the sawteeth of the follower sections in comparison to the spacing between the tooth tips of the engagement section. With this further development of the arrangements it was possible to obtain up to 400 comb plays per minute with a satisfactory combing effect, but it was found that at these high processing speeds the time still available after the actual combing process is no longer sufficient for fusing the combed or still to be combed fiber tuft with a fiber band comprised of already combed fibers. Accordingly, in a subsequent developmental step a shortening of the arrangement length of initially more than 120° in the circumferential direction of the circular comb to less than 110° in the circumferential direction of the circular comb was proposed in order to thus provide even at high processing speeds still sufficient time for fusing. However, it was found that in the last disclosed development of circular combs a considerable impairment of the combing result was observed.

SUMMARY OF THE INVENTION

It is an object of the present invention to provide an arrangement of the aforementioned kind which, when used even at high processing speeds of 400 comb plays per minute or more, provides still sufficient time for fusing the combed fiber tuft with a fiber band comprised of already combed fibers while guaranteeing a satisfactory combing result.

In accordance with the present invention, this is achieved in that at least one of the follower sections in the circumferential direction has a greater length than the engagement section.

This invention is based on the recognition that a gentle and damage-poor engagement of the circular comb arrangement in the supplied fiber tuft can be ensured already when the engagement section extends only over a very small angle in the circumferential direction of the circular comb so that, while guaranteeing a damage-free engagement of the circular comb arrangement via the comparatively short engagement section, a great arrangement length for the more effective arrangement sections is provided without increasing thereby the total length of the arrangement in the circumferential direction. Overall, by using an arrangement which in the circumferential direction of the circular comb extends about an angle of less than 110°, preferably less than 100°, more preferred approximately 90°, a satisfactory combing results can be obtained without damage of the fibers to be processed. With this, even at high processing speeds of 400 comb plays per minute or more sufficient time is still made available for the process of fusing.

With the circular comb arrangement according to the invention an especially good combing result can be achieved with an especially minimal arrangement length while preventing excessive fiber damage, when the arrangement has at least two, preferably at least three, follower sections wherein each has an increased combing effect and/or a greater length than the preceding follower sections, respectively, the engagement section.

In this context, for an arrangement extending over an angle of less than 110°, more preferred approximately 90°, a satisfactory combing result without damage of the fibers upon engagement of the arrangement in the fiber tuft is possible when the ratio of the length of the engagement section to the last follower section is in the range of 1:2 to 1:4.

When using an arrangement comprised of four arrangement sections arranged one after another in the circumferential direction for an arrangement length extending over an angle of approximately 90°, an especially good combing result can be achieved when the lengths of the individual arrangement sections, starting at the engagement section in a direction toward the last follower section, have a ratio of 1:1.2(±0.1):1.8(±0.5):3(±2). The values given in parentheses represent the possible deviations of the especially preferred values given without parentheses.

As has already been explained in detail, when using high performance combers it is especially advantageous when at least one of the arrangement sections, preferably however all arrangement sections, comprise a plurality of sawtooth wire strips arranged adjacent to one another in the direction of the axis of rotation. For such arrangements a higher combing effect of the follower sections can be achieved in comparison to the engagement section when the spacing between the tooth tips of the sawtooth wire strips of the engagement section is greater than that between the tooth tips of the sawtooth wire strips of at least one of the follower sections, preferably of all follower sections.

For an arrangement extending in the circumferential direction of the circular comb over an angle of approximately 90°, an especially high combing effect is ensured while a damage-poor engagement of the arrangement is guaranteed, when the ratio of the spacing between the tooth tips of the engagement section to that between the tooth tips of the last follower section is in the range of 1:0.2 to 1:0.4, preferably approximately 0.35.

In the last described embodiment of the invention using four arrangement sections arranged one after another, an especially good combing result is obtained when the spacings between the tooth tips of the arrangement sections, starting with the engagement section in a direction toward the last follower section, is 1:0.7(±0.2):0.55(±0.1):0.3(±0.1), wherein the values given in parentheses represent the possible deviations of the preferred values given without parentheses. In this context, the spacing between the tooth tips of the engagement section in the stretched arrangement, i.e., before adaptation of the corresponding sawtooth wire to the circular cylinder mantle surface of the base body, is preferably approximately 4 to 5 mm, more preferred approximately 4.47 mm.

In addition, or as an alternative, to the last described embodiment of the invention with changing spacings between the tooth tips of the individual arrangement sections, respectively, a variable tooth division, a higher combing effect of the follower sections in comparison to the engagement section can also be achieved in that the width of the arrangement grooves between the sawtooth wire strips of the engagement section extending in a direction parallel to the axis of rotation is smaller than the width of the arrangement grooves of at least one of the follower sections, preferably of all follower sections. This increase of the combing effect of the follower sections can be achieved, for example, in that the base width of the sawtooth wire strip of the follower sections, while maintaining identical blade width, is increased in comparison to the sawtooth wire strips forming the engagement section. In an especially preferred embodiment of the invention, the base width of the sawtooth wire strips forming the engagement section is approximately 0.8 mm, while the base width of the successively arranged follower section is 0.65, 0.6 or 0.5 mm for identical blade width.

A further additional or alternative possibility for increasing the combing effect of the follower sections in comparison to that of the engagement section resides in that the sawteeth of the engagement section are provided with a smaller breast angle than that of at least one of the follower sections, preferably of all follower sections. In this connection, the breast angle of the sawtooth wire strips, forming the engagement section, in the stretched state, i.e., before application onto the base body of the circular comb, is preferably approximately 30°, while the breast angle of the sawtooth wire strips, forming the follower sections, in the stretched state is approximately 35°, 40° and also for the last follower section is still 40°. In other applications, such as, for example, the combing of short staple cotton, for which only a minimal combing effect is desired, the breast angle of all follower sections as well as the breast angle of the engagement section can be 30°. On the other hand, when processing long staple material, the breast angle of the last follower section can be up to 55° wherein the breast angle of the other follower sections can also be increased accordingly.

Finally, in the circular comb arrangements according to the invention it may also be provided that the tooth height of the sawteeth of the engagement section is greater than that of the sawteeth of at least one follower section, preferably of all follower sections.

In an especially advantageous embodiment of the invention all of the aforementioned measures for increasing the combing effect are applied in the embodiments of the follower sections, wherein expediently all arrangement sections have approximately the same arrangement height for maintaining a disturbance-free operation of the comber.

As can be taken from the afore disclosed description of the arrangements according to the invention, a circular comb produced accordingly has a substantially circular cylindrical support body, a base body extending over a portion of the cylinder circumference and expanding the support body in the radial direction, as well as an arrangement mounted on the base body, wherein the arrangement comprises at least two arrangement sections arranged one after another in the circumferential direction and having combing effects that differ from one another, wherein at least one of the follower sections passing through a fiber band after the engagement section has a greater length in the circumferential direction than the engagement section.

DESCRIPTION OF THE PREFERRED EMBODIMENTS

Figure 1A:
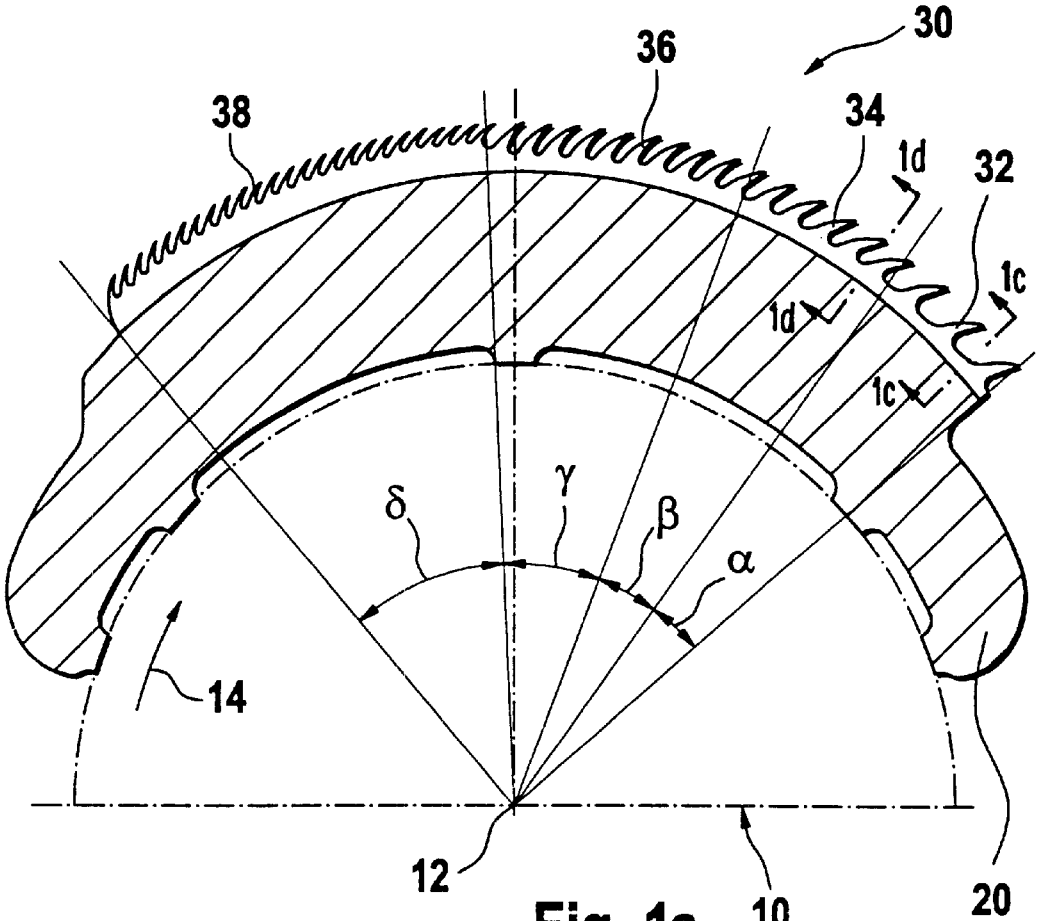
FIG. 1*a* is a schematic radial sectional view of the circular comb according to the invention.

The circular comb illustrated in FIG. 1 comprises a substantially circular cylindrical support body 10, a base body 20 extending in the circumferential direction along a portion of the mantle surface of the circular cylindrical mantle-shaped support body 10 and expanding the latter in the radial direction, as well as an all-steel sawtooth arrangement identified in its entirety by numeral 30 which is arranged on the outer surface of the base body 20. The complete configuration comprised of the arrangement 30, the base body 20, and the support body 10 can be rotated about the cylinder axis 12 of the support body 10, as indicated by arrow 14. The arrangement 30 is comprised of a total of four arrangement sections 32, 34, 36, and 38 arranged one after another in the circumferential direction, wherein the arrangement section 32, referred to in the following as engagement section, first engages a fiber tuft to be combed upon rotation in the direction indicated by arrow 14, while the arrangement sections 34, 36, and 38 (in the following referred to as follower sections) pass through the fiber tuft in this engagement sequence.

Each of the arrangement sections 32, 34, 36, and 38 is comprised of a plurality of sawtooth wire strips arranged in the direction of the cylinder axis 12 adjacent to one another. In this connection, the engagement section 32 extends in the circumferential direction of the support body 10, respectively, of the base body 20 over an angle $\alpha$ of approximately 13°, the first follower section 34 adjacent thereto over an angle $\beta$ of approximately 15.5°, the second follower section 36 adjacent to the first follower section 34 over an angle $\gamma$ of approximately 23.5°, and the third follower section 38 adjacent to the second follower section 36 over an angle $\delta$ of approximately 38° so that the entire arrangement 30 extends over an angle of approximately 90° in the circumferential direction. As can be seen already in the representation of FIG. 1, the spacing between the tooth tips of the follower sections 34, 36, and 38 is respectively smaller than the spacing between the tooth tips of the preceding follower sections 36 and 34, respectively, of the engagement section 32. Already with this measure it is achieved that the combing effect of the arrangement 30 upon passing through a fiber tuft is continuously increased from arrangement section to arrangement section in the engagement sequence as the arrangement passes through the fiber tuft while a gentle engagement of the fiber tuft is achieved with the engagement section 32 engaging the fiber tuft first.

Figure 1B:
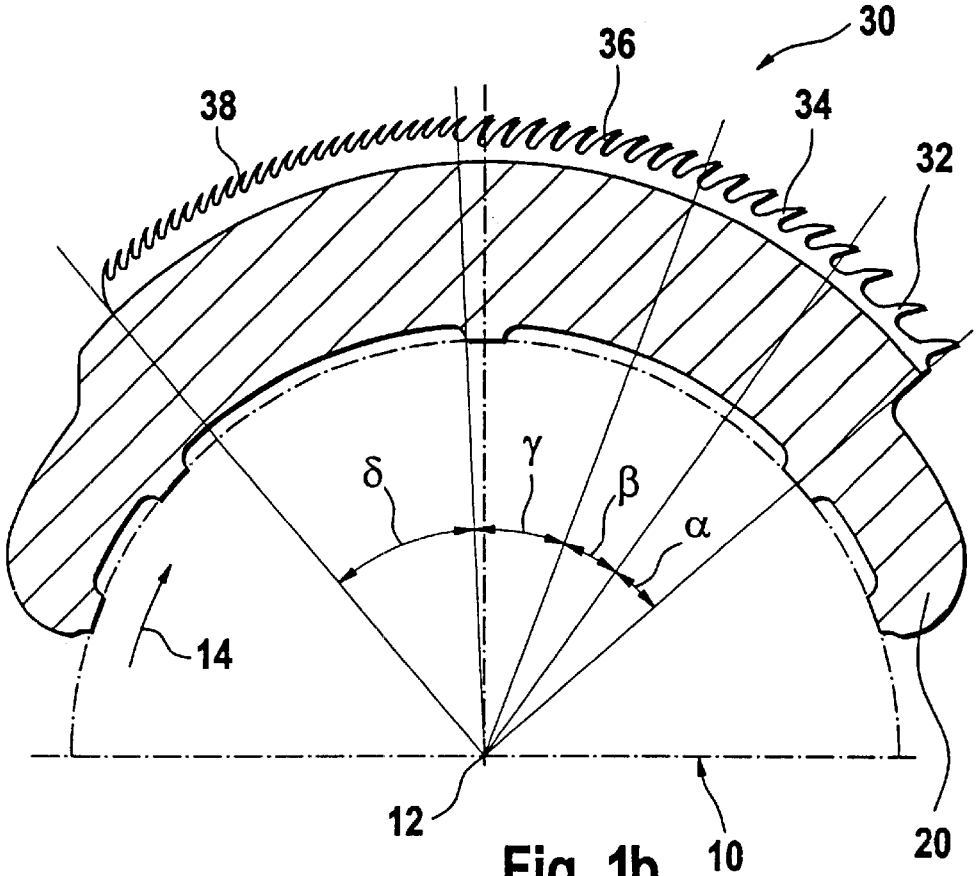
FIG. 1*b* is a schematic radial sectional view of another embodiment of the circular comb according to the invention.

As shown in FIG. 1*b*, the sawteeth of the engagement section 32 have a tooth height that is greater than the tooth height of the sawteeth of the follower sections.

Figure 1C:
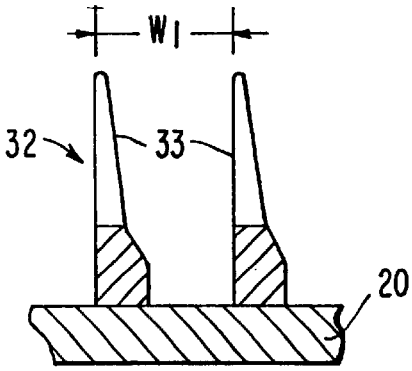
FIGS. 1*c* and 1*d* are sectional views taken along sectional lines 1*c*—1*c* and 1*d*—1*d*, respectively of FIG. 1*a*.
Figure 1D:
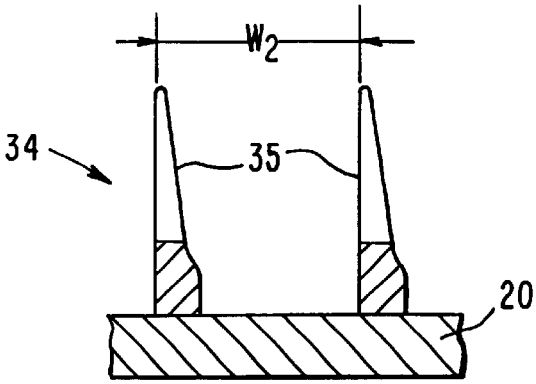

As can be seen in FIGS. 1*c* and 1*d*, the width $w_1$ of the arrangement grooves of the engagement section 32 is smaller than the width $w_2$ of the arrangement grooves of the follower section 34.

Further details with respect to the sawtooth wire strips for producing the arrangement section 32, 34, 36, and 38 can be taken from FIGS. 2*a* to 2*d* in connection with the following description.

In FIGS. 2*a* to 2*d* sawtooth wires 33, 35, 37, 39 employed for producing the arrangement sections 32, 34, 36, and 38 are illustrated in the stretched state, i.e., before application onto the base body 20.

Figure 2A:
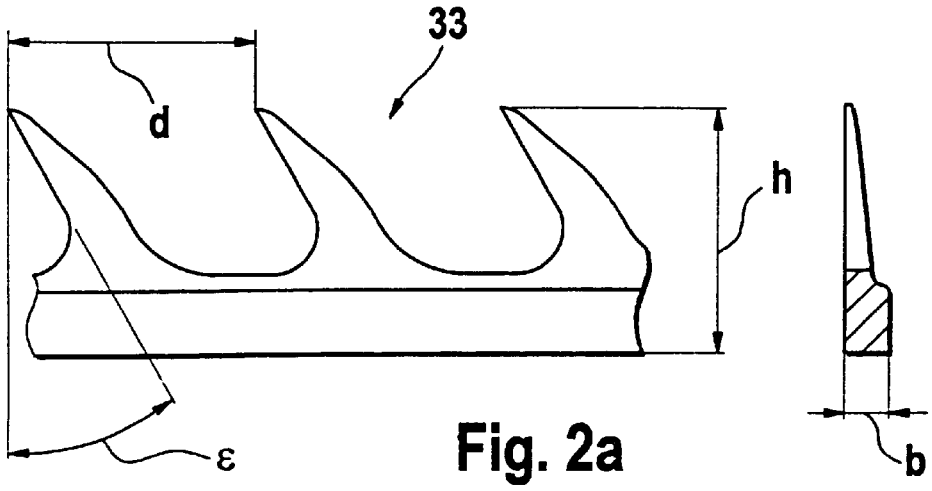
FIGS. 2*a* to 2*d* show detail representations of sawtooth wire strips which can be used for producing the individual arrangement sections of the circular comb illustrated in FIG. 1.

The sawtooth wire 33, illustrated in FIG. 2*a* and used for producing the section 32, has a spacing d between the tooth tips of adjacently positioned teeth of approximately 4.47 mm. The total height h of the sawtooth wire is 4.5 mm, the breast angle $\epsilon$ is 30°, and the width b of the sawtooth wire base is 0.8 mm.

Figure 2B:
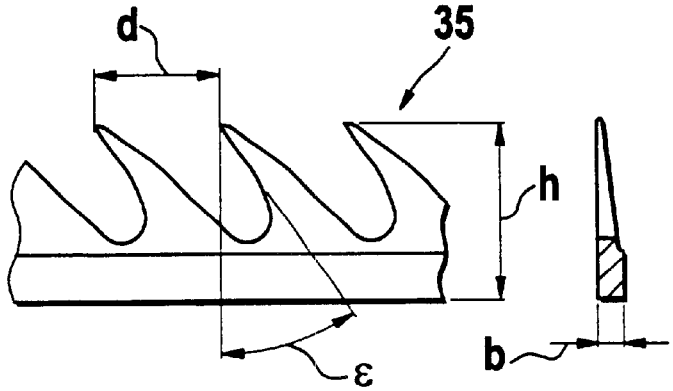

The sawtooth wire 35, illustrated in FIG. 2*b* and used for producing the section 34, has a spacing d between the tooth tips of adjacently positioned teeth of approximately 3.14 mm, the arrangement height h is approximately 4.5 mm, the base width b is approximately 0.65 mm, and the breast angle $\epsilon$ is approximately 35°.

Figure 2C:
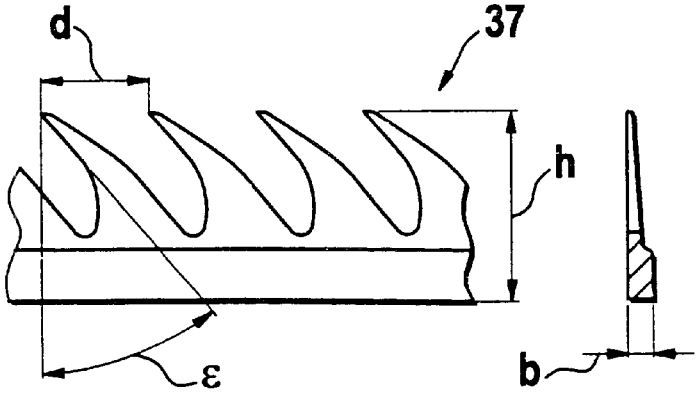

The sawtooth wire strip 37, illustrated in FIG. 2*c* and used for producing the section 36, has a spacing between the tooth tips of adjacently positioned teeth of approximately 2.502 mm, the arrangement height h is Approximately 4.5 mm, the base width b is approximately 0.6 mm, and the breast angle $\epsilon$ is approximately 40°.

Figure 2D:
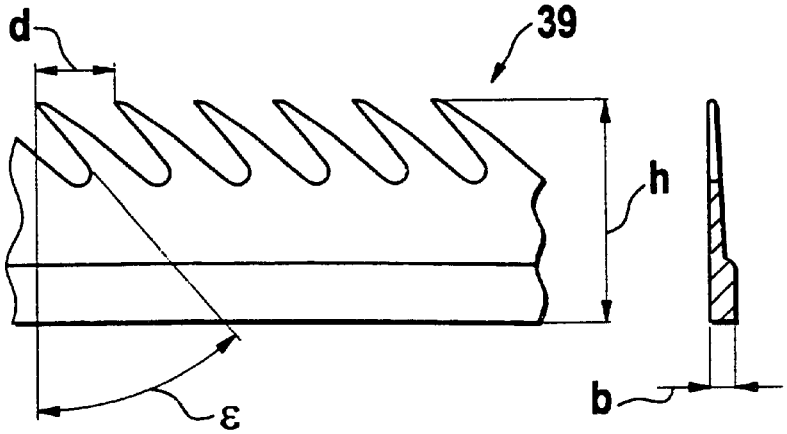

Finally, the sawtooth wire strip 39, illustrated in FIG. 2*d* and used for producing the follower section 38, has a spacing d between the tooth tips of adjacently positioned teeth of approximately 1.574 mm, an arrangement height h of approximately 4.5 mm, a base width b of approximately 0.5 mm, and a breast angle $\epsilon$ of approximately 40°.

The invention is not limited to the embodiment illustrated in the drawing. Instead, the use of arrangements with more or fewer than four arrangement sections is conceivable. In this connection, the arrangement overall can extend also over an angle of more or less than 90°. Moreover, the sawtooth wire strips of the individual arrangement sections can also have the same base width, the same spacing between the tooth tips of adjacently positioned teeth and/or the same breast angle or can be dimensions deviating from the described embodiment, as long as it is ensured that the combing effect of one of the follower sections 34, 36 or 38 is greater than that of the engagement section 32.

While specific embodiments of the invention have been shown and described in detail to illustrate the inventive principles, it will be understood that the invention may be embodied otherwise without departing from such principles.

What is claimed is:

1. An arrangement for a rotatable circular comb for processing fibers supplied in the form of a fiber band, the arrangement comprising:

arrangement sections configured to be fastened on a circular cylindrical mantle surface that is configured to rotate about an axis of rotation in a direction of rotation;

the arrangement sections arranged behind one another in a circumferential direction of the circular cylindrical mantle surface and configured such that the arrangement sections successively engage the fiber band in an engagement sequence when the arrangement is rotated in the direction of rotation;

wherein a first one of the arrangement sections engaging the fiber band first in the engagement sequence upon rotation of the arrangement is an engagement section and wherein the arrangement sections arranged successively behind the engagement section are follower sections;

wherein the engagement section has a lesser combing effect than at least one of the follower sections; and wherein at least one of the follower sections has a greater length in the circumferential direction than the engagement section, and wherein at least two of the follower sections are provided and wherein each one of the follower sections has a higher combing effect than the follower section or the engagement section directly preceding each one of the follower sections in the engagement sequence.

2. The arrangement according to claim 1, wherein the arrangement extends over an angle of less than 110° in the circumferential direction.

3. The arrangement according to claim 2, wherein the arrangement extends over an angle of less than 100° in the circumferential direction.

4. The arrangement according to claim 3, wherein the arrangement extends over an angle of approximately 90° in the circumferential direction.

5. The arrangement according to claim 1, wherein at least one of the arrangement sections has a plurality of sawtooth wire strips arranged adjacent to one another in the direction of the axis of rotation.

6. The arrangement according to claim 5, wherein each one of the arrangement sections has a plurality of sawtooth wire strips arranged adjacent to one another in the direction of the axis of rotation.

7. The arrangement according to claim 6, wherein all of the arrangement sections have the same arrangement height.

8. The arrangement according to claim 5, wherein the sawtooth wire strips of the arrangement sections have sawteeth with tooth tips and wherein a spacing between the tooth tips of the engagement section is greater than a spacing between the tooth tips of at least one of the follower sections.

9. The arrangement according to claim 8, wherein a ratio of the spacing between the tooth tips of the engagement section to the spacing between the tooth tips of the last one of the follower section in the direction of rotation is in the range of 1:0.2 to 1:0.4.

10. The arrangement according to claim 9, wherein the ratio is approximately 1:0.35.

11. The arrangement according to claim 9, having a first, second and third follower section in the engagement sequence, wherein the ratio of the spacings between the tooth tips of the engagement section to the first, second and third follower sections is 1:0.7(±0.2):0.55(±0.1):0.3(±0.1).

12. The arrangement according to claim 8, wherein the sawteeth of the engagement section have a breast angle that is smaller than a breast angle of the sawteeth of at least one of the follower sections.

13. The arrangement according to claim 12, wherein the breast angle of the sawteeth of the engagement section is smaller than the breast angle of the sawteeth of all of the follower sections.

14. The arrangement according to claim 8, wherein the sawteeth of the engagement section have a tooth height that is greater than a tooth height of the sawteeth of at least one of the follower sections.

15. The arrangement according to claim 14, wherein the tooth height of the sawteeth of the engagement section is greater than the tooth height of the sawteeth of all of the follower sections.

16. The arrangement according to claim 5, wherein between the sawtooth wire strips of the arrangement sections arrangement grooves are formed that extend in a direction parallel to the axis of rotation, wherein a width of the arrangement grooves of the engagement section is smaller than a width of the arrangement grooves of at least one of the follower sections.

17. The arrangement according to claim 16, wherein the width of the arrangement grooves of the engagement section is smaller than the width of the arrangement grooves of all of the follower sections.

18. An arrangement for a rotatable circular comb for processing fibers supplied in the form of a fiber band, the arrangement comprising:

arrangement sections configured to be fastened on a circular cylindrical mantle surface that is configured to rotate about an axis of rotation in a direction of rotation;

the arrangement sections arranged behind one another in a circumferential direction of the circular cylindrical mantle surface and configured such that the arrangement sections successively engage the fiber band in an engagement sequence when the arrangement is rotated in the direction of rotation;

wherein a first one of the arrangement sections engaging the fiber band first in the engagement sequence upon rotation of the arrangement is an engagement section and wherein the arrangement sections arranged successively behind the engagement section are follower sections;

wherein the engagement section has a lesser combing effect than at least one of the follower sections; and wherein at least one of the follower sections has a greater length in the circumferential direction than the engagement section, and wherein at least two of the follower sections are provided and wherein each one of the follower sections has a greater length than the follower section or the engagement section directly preceding each one of the follower sections in the engagement sequence.

19. An arrangement for a rotatable circular comb for processing fibers supplied in the form of a fiber band, the arrangement comprising:

arrangement sections configured to be fastened on a circular cylindrical mantle surface that is configured to rotate about an axis of rotation in a direction of rotation;

the arrangement sections arranged behind one another in a circumferential direction of the circular cylindrical mantle surface and configured such that the arrangement sections successively engage the fiber band in an engagement sequence when the arrangement is rotated in the direction of rotation;

wherein a first one of the arrangement sections engaging the fiber band first in the engagement sequence upon rotation of the arrangement is an engagement section and wherein the arrangement sections arranged successively behind the engagement section are follower sections;

wherein the engagement section has a lesser combing effect than at least one of the follower sections; and wherein at least one of the follower sections has a greater length in the circumferential direction than the engagement section, and wherein at least two of the follower sections are provided and wherein each one of the follower sections has a higher combing effect and a greater length than the follower section or the engagement section directly preceding each one of the follower sections in the engagement sequence.

20. An arrangement for a rotatable circular comb for processing fibers supplied in the form of a fiber band, the arrangement comprising:

arrangement sections configured to be fastened on a circular cylindrical mantle surface that is configured to rotate about an axis of rotation in a direction of rotation;

the arrangement sections arranged behind one another in a circumferential direction of the circular cylindrical mantle surface and configured such that the arrangement sections successively engage the fiber band in an engagement sequence when the arrangement is rotated in the direction of rotation;

wherein a first one of the arrangement sections engaging the fiber band first in the engagement sequence upon rotation of the arrangement is an engagement section and wherein the arrangement sections arranged successively behind the engagement section are follower sections;

wherein the engagement section has a lesser combing effect than at least one of the follower sections; and wherein at least one of the follower sections has a greater length in the circumferential direction than the engagement section, wherein a ratio of a length of the engagement section to a length of the last one of the follower sections in the engagement sequence is 1:2 to 1:4.

21. An arrangement for a rotatable circular comb for processing fibers supplied in the form of a fiber band, the arrangement comprising:

arrangement sections configured to be fastened on a circular cylindrical mantle surface that is configured to rotate about an axis of rotation in a direction of rotation;

the arrangement sections arranged behind one another in a circumferential direction of the circular cylindrical mantle surface and configured such that the arrangement sections successively engage the fiber band in an engagement sequence when the arrangement is rotated in the direction of rotation;

wherein a first one of the arrangement sections engaging the fiber band first in the engagement sequence upon rotation of the arrangement is an engagement section and wherein the arrangement sections arranged successively behind the engagement section are follower sections;

wherein the engagement section has a lesser combing effect than at least one of the follower sections; and wherein at least one of the follower sections has a greater length in the circumferential direction than the engagement section, and wherein the arrangement has three follower sections, and wherein a ratio of lengths of the arrangement sections in the engagement sequence is in the range of 1:1.2(±0.1):1.8(±0.5):3(±1).

* * * * *